United States Patent [19]

Elstner

[11] 4,350,245

[45] Sep. 21, 1982

[54] MEDICAL KIT FOR THE PROTECTIVE STORAGE OF TEAT SWABS

[76] Inventor: Hans Elstner, 8867 Oettingen, Fed. Rep. of Germany

[21] Appl. No.: 178,749

[22] Filed: Aug. 18, 1980

[30] Foreign Application Priority Data

Aug. 23, 1979 [DE] Fed. Rep. of Germany ..... 2934156

[51] Int. Cl.[3] ..... B65D 85/20; B65D 85/62; B65D 81/00

[52] U.S. Cl. ..... 206/207; 206/362; 206/443

[58] Field of Search ..... 206/362, 361, 207, 443; 220/339, 375, 20, 21

[56] References Cited

U.S. PATENT DOCUMENTS

| | | | |
|---|---|---|---|
| 1,799,059 | 3/1931 | Naylor | 206/207 |
| 2,615,562 | 10/1952 | Rothbardt | 206/362 |
| 4,029,202 | 6/1977 | Lasich et al. | 220/375 |

*Primary Examiner*—William T. Dixson, Jr.
*Attorney, Agent, or Firm*—Erwin S. Teltscher

[57] ABSTRACT

A medical kit for the protective storage of teat swabs includes a container inclusive of a container body provided with a lid and holding the teat swabs and a salve. An insert extending toward the container floor is located in the container body and is provided with holders for storing the teat swabs. At least one hollow space is located below the insert in the bottom area of the container and adapted to hold the salve, into which the lower tip of the teat swab may be dipped.

20 Claims, 8 Drawing Figures

MEDICAL KIT FOR THE PROTECTIVE STORAGE OF TEAT SWABS

BACKGROUND OF THE INVENTION

The present invention refers to a medical kit, including container for preserving teat swabs with a maximum of protection from impurities and germs and for holding them available for immediate and rapid use upon their removal from the protective container.

Teat swabs serve for the treatment of inflammations of the milk passages in the teats and udders of lactating animals. The swabs are inserted from without into the milk duct of the teat after the lower tip has been coated with a salve enabling easier insertion of the test swabs on the one hand and containing medicated substances on the other. As a rule, the teat swabs comprise a thin wire covered with textile fibers which can also be saturated with medication.

In the past it was common practice to keep teat swabs of the type in question in a container whose interior can be subdivided into two compartments, one holding the swabs themselves and the other containing the salve. Upon application of the swabs, the tip is dipped to a greater or lesser depth into the salve in order to moisten the tip. As experience, shows, storage containers of this type have considerable disadvantages. They are above all virtually unprotected from soiling and infestation with germs inevitably occurring in the coarse operation of livestock farms. Furthermore, as a rule the hands of the persons using the teat swabs are not as clean as they should be, and when a teat swab kept in a storage container is grasped, it happens frequently enough that the remaining swabs in the container become soiled. In addition, the lid of the container occasionally falls to the ground, which also has similar results.

SUMMARY OF THE INVENTION

The object of the present invention is to provide a medical kit, including container in which the teat swabs can be safely kept and made available for use in such a way that they can be taken by the grip alone and applied immediately. By this means the swab itself is no longer touched and it remains clean up till its insertion in the milk channel of a teat. It should also be possible if desired to be able to moisten the teat swabs quickly and easily with medication or the like before their use.

For the purpose of attaining this object the proposal according to the invention is to design the teat swab protective container in question in such a way that an insert extending toward the base area and containing receptacles for the swabs is located in the container. Beneath these receptacles a hollow space for the salve is located in the container interior.

Additional features can be found in the dependent claims and in the following description of the preferred embodiments of a protective teat swab container presented in FIGS. 1–7 of the drawings.

PREFERRED EMBODIMENTS

Figure 1:
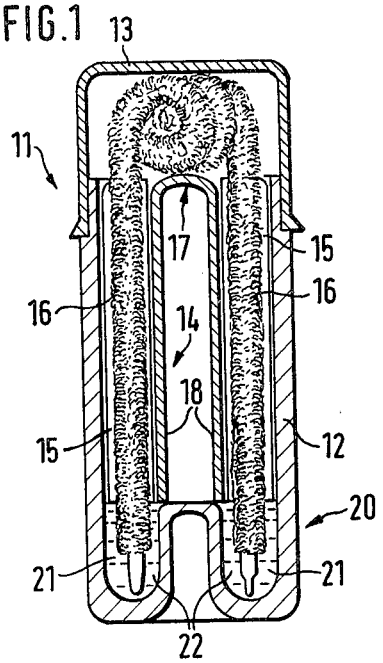
FIG. 1 shows a longitudinal cross section of a container having a rectangular base area.

As can be seen in FIG. 1, container 11 includes a container body 12 capable of being closed by a lid 13. An insert 14 provided with numerous receptacles 15 for the teat swabs 16 is located in the interior of the container body 12. In this embodiment the insert 14 comprises a piece of foil, for example, folded into a U-shape, wherein the yoke portion 17 connects the mutually opposing side portions 18 with each other, in which side portions the channel-shaped holders 15 for storing the teat swabs 16 are formed.

At least at their uppermost ends, the width of the holder channels 15 in the insert 14 is such that the teat swabs 16 are as closely enclosed as possible in order to prevent dirt from reaching them. By means of this type of individual storage and safekeeping, undesirable contact between the swabs 16 themselves can be avoided.

In the base area 20 of the container body 12, two trough-like channels 21 holding the salve 22 are located, into which salve the lower extremities of the teat swabs are dipped.

Figure 3:
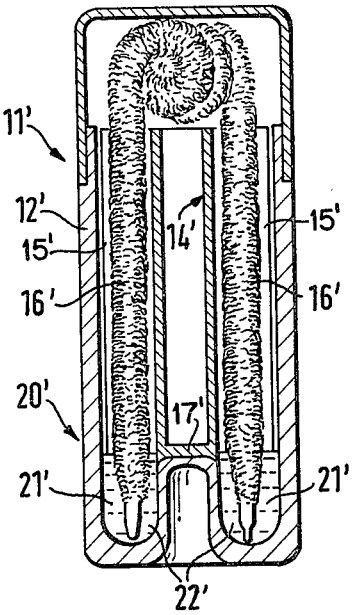
FIG. 3 shows a longitudinal cross section of a container in a modified embodiment, but similar to the container according to FIGS. 1 and 2.
Figure 2:
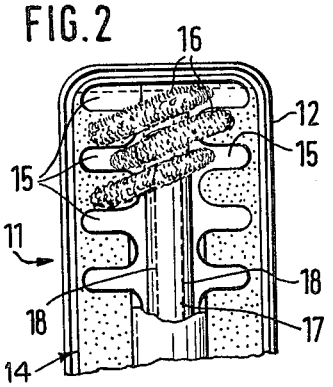
FIG. 2 shows a view plan of a portion of the container according to FIG. 1 with the lid removed, but with the teat swabs shown in positions different from those occupied in FIG. 2.

A modified form of the embodiment of the above-described teat swab container can be seen in FIG. 3. This embodiment merely differs from that of FIG. 1 in that the insert 14′ is positioned upside down in the container body 12′; that is, the yoke portion 17′ is located in the base area 20′, thus covering the upper portion of the channels 21′ containing the salve 22′. This has the advantage that, if the teat swab 16′ is pushed into the salve 22′, the displaced salve then rises into the receptacle 15′, thus coating a greater length of the teat swab 16′.

Figure 4:
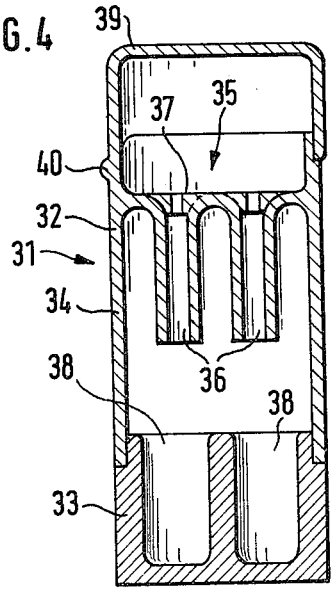
FIG. 4 shows a longitudinal cross section of a second embodiment of a teat swab container.

An embodiment of a protective container 31 for teat swabs can be seen in FIG. 4. In this embodiment, the container body 32 is designed in two parts. It consists of the removable base portion 33 and the middle portion 34 to which the base portion 33 can be securely clamped. The insert 35 with the tubular holders 36 for the teat swabs is connected to the middle portion 34. The insert can be loosely fitted to the middle portion 34 or, as shown in FIG. 4, it can form an integral part therewith. The plate 37 carrying the holder tubes 36 closes off the interior of the container middle portion 34 at its upper end. Underneath the tubes 36, bowl-like depressions 38 for holding the salve are arranged in the base portion 33. The lid 39 is connected to the container middle portion 34 in a known manner by means of a plastic hinge joint 40, having the advantage that the lid can not fall to the ground or become lost.

Figure 5:
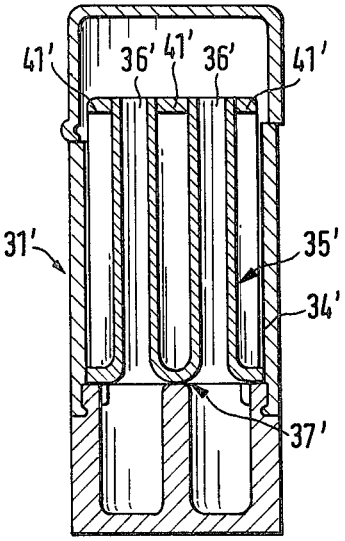
FIG. 5 shows a longitudinal cross section of a modification of the container according to FIG. 4.

Similar to the case in the teat swab container 11′ according to FIG. 4, the insert 35′ in the variant according to FIG. 5 is placed in an inverted position in the interior of the container middle portion 34′. The tubular holders 36′ are advantageously supported by the cross-pieces 41′.

Figure 6:
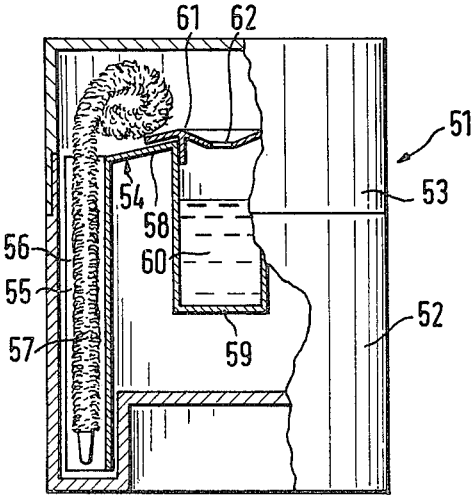
FIG. 6 shows a longitudinal cross section of a round container for teat swabs.

As seen in FIG. 6, the teat swab container 51 comprises a round container body 52 with a lid 53. The insert 54 has the form of an overturned cup in whose walls 55 channel-like holders 56 for the teat swabs 57 are formed. In the center of the floor 58 an indentation 59 for holding a medication 60 is located, wherein said indentation is closed by means of the cover 61. This cover has a hole 62 through which the teat swab can be dipped in the medication.

Figure 7:
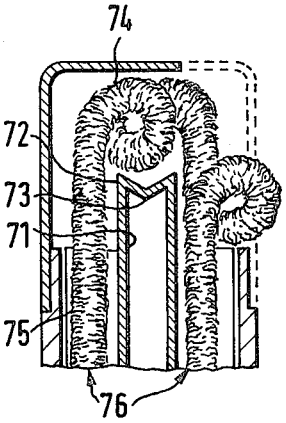
FIG. 7 shows a longitudinal cross section of the upper portion of a teat swab container in a modified form as opposed to the container according to FIG. 1.

If the teat swabs are not supposed to be dipped in the salve or the like during storage, then, as can be seen in FIG. 7, the insert 71 can be provided with a ledge 72 with a resting groove 73. The grip 74 of the teat swab 75 can then be positioned at a higher level on this ledge so that the lower extremity comes to rest above the salve or the like. Thus the teat swab tip can be coated with salve immediately before use of the swab by pushing the swab deeper into its holder 76 and then extracting it.

Figure 8:
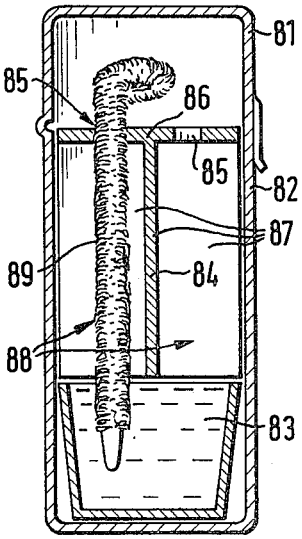
FIG. 8 shows a longitudinal cross section of a further embodiment of a teat swab container.

In the embodiment according to FIG. 8, a base trough 83 filled with the salve is placed in the container 82 provided with a hinged lid 81. The insert 84 is located above the base trough 83 and comprises an upper horizontal cover plate 86 provided with holes 85, and partitions 87 attached to the cover plate and extending downward, by means of which partitions and interior of the container 82 is subdivided into individual compartments 88, each containing one teat swab 89 inserted through the holes 85 in the cover plate, with the result that the swab is protected in the desired manner. If dirt should fall through a hole 85 after the removal of a teat swab, then the remaining test swabs located in the interior of the container 82 are thus unaffected due to the fact that each individual teat swab compartment 88 is closed off from the adjacent compartments.

What is claimed is:

1. A medical kit comprising in combination a container including a container body formed with a hollow space in a lower portion thereof, said lower portion being adapted to hold a viscous salve, a lid at least partly removable from said container body, and elongated insert means insertable into said container body above said hollow space and having a plurality of upright longitudinal compartmentalized spaces open at each end, and a plurality of teat swabs arranged to be stored in said compartmentalized spaces, each teat swab being made of a chenille-covered wire for insertion into the milk duct of the udders of lactating cows, and having a rod portion including a lower end part in the form of a rounded plastic tip, and a handle in the form of a spirally rolled upper end, at least one of said hollow and compartmentalized spaces being arranged to hold said lower end part of one of said swabs, the upper end of each compartmentalized space being arranged to be closed off upon insertion of said rod portion of a swab thereinto, whereby, upon said viscous salve filling said hollow space at least up to the lower ends of said compartmentalized spaces, contamination of the rod portion of each teat swab is precluded, even when any of the remaining teat swabs are removed from respective of said compartmentalized spaces.

2. The medical kit as claimed in claim 1, wherein said container body has an inner wall, and said insert means abuts said inner wall, and includes a plate formed with openings communicating with said open ends of said compartmentalized spaces, respectively, said compartmentalized spaces forming holders for said teat swabs.

3. The medical kit as claimed in claim 2, wherein said plate is connected to said inner wall.

4. The medical kit as claimed in claim 2, wherein said plate is integral with said inner wall.

5. The medical kit as claimed in claim 2, wherein said plate faces said lid.

6. The medical kit as claimed in claim 2, wherein said plate faces said hollow space.

7. The medical kit as claimed in claim 1, wherein said insert means has in the central part thereof a U-shaped longitudinal cross-section.

8. The medical kit as claimed in claim 7, wherein said insert means is inserted into said container body, so that said U-shaped cross-section of said insert means is upright.

9. The medical kit as claimed in claim 7, wherein said insert means is inserted into said container body, so that the U-shaped cross section of said insert means is inverted.

10. The medical kit as claimed in claim 1, wherein said insert means includes an upper plate formed with openings, and tubular holders attached to said upper plate establishing said compartmentalized spaces, the upper open ends of said compartmentalized spaces communicating with said openings, respectively.

11. The medical kit as claimed in claim 1, wherein said insert means has a rectangular cross-section perpendicular to the direction of elongation.

12. The medical kit as claimed in claim 1, wherein said insert means has a round cross-section perpendicular to the direction of elongation.

13. The medical kit as claimed in claim 1, wherein said container body defines in a lower portion thereof a plurality of channels, said channels forming said hollow space.

14. The medical kit as claimed in claim 13, wherein said container body includes an upper portion, and a lower portion removable from said upper portion.

15. The medical kit as claimed in claim 14, wherein said lid comprises a hinge connecting it to said upper portion.

16. The medical kit as claimed in claim 1, wherein the lower end part of each teat swab is adapted to be normally submerged in said viscous salve, and wherein said insert means has a top portion formed with a groove, each teat swab being movable between a first position, wherein its lower end part is submerged in said salve, and its handle is remote from said groove, and a second position wherein its handle rests in said groove, its lower end part thereby being withdrawn from said salve.

17. The medical kit as claimed in claim 1, wherein said insert means has in an upper part thereof a central depressed portion in the shape of a bowl adapted to hold medication means.

18. The medical kit as claimed in claim 17, further comprising a cover formed with a hole, said cover being arranged to close off said depressed portion.

19. The medical kit as claimed in claim 1, wherein said insert means comprises a base trough disposed in said hollow space, and being adapted to hold said viscous salve.

an insert element located above said base trough including an upper plate formed with openings, and at least one partition extending downwardly from said upper plate towards said base trough, and forming in conjunction with said upper plate and said inner wall said compartmentalized spaces, said openings in said upper plate communicating with said compartmentalized spaces.

20. A medical kit comprising in combination a container including a container body formed with a hollow space in a lower portion thereof, said lower portion being adapted to hold a viscous salve, a cover at least partly removable from said container body, and elongated insert means insertable into said container body above said hollow space and having a plurality of upright longitudinal compartmentalized spaces open at each end, and including an upper plate formed with openings communicating with said compartmentalized spaces, respectively, and a plurality of teat swabs arranged to be stored in said compartmentalized spaces, each teat swab being made of a chenille-covered wire for insertion into the milk duct of the udders of lactating cows, and having a rod portion including a lower end part in the form of a rounded plastic tip, and a handle in the form of a spirally rolled upper end, at least one of said hollow and compartmentalized spaces being arranged to hold said lower end part of one of said swabs, the upper end of each compartmentalized space being arranged to be closed off upon insertion of said rod portion of a swab thereinto, whereby, upon said viscous salve filling said hollow space at least up to the lower ends of said compartmentalized spaces, contamination of the rod portion of each teat swab is precluded, even when any of the remaining teat swabs are removed from respective of said compartmentalized spaces.

* * * * *